United States Patent [19]

Gaspar

[11] Patent Number: 4,536,176

[45] Date of Patent: Aug. 20, 1985

[54] CRIMP BLADE HOLDER

[75] Inventor: Richard A. Gaspar, Dayton, Ohio

[73] Assignee: Harris Graphics Corporation, Melbourne, Fla.

[21] Appl. No.: 534,514

[22] Filed: Sep. 21, 1983

[51] Int. Cl.[3] ..... B42B 2/00

[52] U.S. Cl. ..... 493/365; 493/370; 270/53

[58] Field of Search ..... 493/60, 63, 64, 363, 493/365, 367, 324, 370; 270/37, 53

[56] References Cited

U.S. PATENT DOCUMENTS

| | | | |
|---|---|---|---|
| 2,935,002 | 5/1960 | Robinson, Jr. | 493/363 |
| 3,727,908 | 4/1973 | Whitesell et al. | 270/53 |
| 4,114,869 | 9/1978 | Gladow et al. | 270/37 |
| 4,422,630 | 12/1983 | Trentman | 270/53 |

*Primary Examiner*—Francis S. Husar
*Assistant Examiner*—Jorji M. Griffin
*Attorney, Agent, or Firm*—Biebel, French & Nauman

[57] ABSTRACT

A holder mounting a plurality of crimp blades for crimping of a moving web includes a cylindrical body having a curved outer surface, and eight slots defined in the outer surface. A crimp blade is secured within each of the slots such that rotation of the body causes the blades to crimp a web moving therepast. The diameter of the body and the positions of the blade mounting slots on the surface thereof are selected so that with the blades mounted to the body, rotation thereof causes crimps to be applied to the moving web with spacings thereon between successive crimps defining a repetitive pattern of substantially 2.0, 2.0, 2.0, 2.0, 2.0, 2.0, 2.0 and 3.0 inches (5.08, 5.08, 5.08, 5.08, 5.08, 5.08, 5.08 and 7.62 cm).

7 Claims, 11 Drawing Figures

CRIMP BLADE HOLDER

BACKGROUND OF THE INVENTION

The present invention relates to a device for holding a plurality of blades such as might be used for crimping a moving multipart paper web at a plurality of locations along its length. Such a holder is particularly useful in machines for collating several paper webs, such as might be done in the manufacture of business forms.

Multipart, preprinted business forms are commonly used, for instance, where it is desired to make multiple copies of a document at the same time. In manufacturing such forms, a single web is printed for each part, or layer, of the form, and the individual webs are then supplied to a collator for proper arrangement into layers. Depending upon the particular forms, carbon paper may be interleaved between the various printed parts of the multipart web. In the production of continuous forms, after collating, a perforation is provided across the web at a plurality of predetermined locations, so that individual forms may be separated from the web for use. The individual forms typically are not separated until immediately before or after use, and the forms are packaged for shipment and/or storage by folding the web in accordion-like fashion along the perforations.

In order to keep the various parts of the form together until such time as it is desired to separate them, it is common to provide a plurality of crimps along each edge of the multipart web during collating. The crimping is normally performed by a series of crimp blades, each of which has a plurality of teeth for cooperating with grooves provided in an anvil surface. The teeth puncture and pass through the web into the grooves of the anvil surface, thereby providing a plurality of slots through the parts of the web. The crimp blades are designed, however, to cut the paper on only three sides of each slot. The small portions of paper orginally located where the slots are formed are thus not severed from the web, but remain attached and are pushed downwardly through the slot formed in the underlying parts. These small paper tabs interlock with one another to hold the various parts together.

The crimp blades are usually mounted to one or more blade holders, an example of which is disclosed in U.S. Pat. No. 2,935,002, issued May 3, 1960 to Robinson, which in turn are mounted to a rotatable shaft. The multipart web is passed between the blade holders and the cooperating anvil surface, and the blade holder shaft is rotated at a speed such that the teeth of the crimp blades and the web approach each other at the same linear speed. Thus, as the web is passed by the blade holders, the blades crimp the web in a pattern predetermined by the arrangement of the blades along the holders.

In addition to the perforations provided across the multipart web, and the crimping provided along the edges of the web, the web is further provided with a series of holes along each of its edges. These holes may be used for advancing the web, both during manufacture of the forms, and during their subsequent use, for instance, where the individual forms are prepared by a computer printer. Typically, the holes are disposed along the edge of the web at a spacing of 0.50 inch (1.27 cm) center-to-center, and equipment used with forms has been designed to be compatible with such spacing.

Thus, to be effective, the crimps must be located along the web so as to avoid the holes. Accordingly, as can be seen in FIG. 1, the crimps are typically centered 0.25 inch (0.635 cm) from the centers of adjacent holes, and are thereby separated from other crimps by an integer number of half-inches.

The perforations separating successive forms represent yet another constraint on the location of the crimps. These cross perforations, typically formed on the web after crimping, must be located so as not to fall on the holes. Thus, as seen in FIG. 1, the perforations are also located 0.25 inch (0.635 cm) from the centers of adjacent holes. It is not desirable, however, for the crimps to fall where a cross perforation will occur. In such a case, the crimps could cause premature, partial separation of individual forms along the perforation, thereby making accidental full separation much more likely. Moreover, the crimps prevent even, neat folding along the perforations, interfering with the proper arrangement of the web for storage and/or shipping.

The separation between consecutive perforations along the web is, of course, determined by the desired length for the form. In the United States, the two most common lengths for forms are $8\frac{1}{2}$ inches (21.6 cm) and 11 inches (27.9 cm), and in Europe, the most common lengths are 8 inches (20.3 cm) and 12 inches (30.5 cm). In the case of 8-inch, 11-inch and 12-inch forms, as well as any other form of a length of an integer number of inches, it can be seen that consecutive perforations are separated by an even number of half-inch intervals. The crimp blades can therefore be arranged to provide crimps in intervals of an even number of half-inches. By separating the initial crimp from the initial perforation by an odd number of half-inch intervals, the perforations and crimps will not coincide.

This approach is not usable in the case of $8\frac{1}{2}$ inch forms. With $8\frac{1}{2}$ inch forms (21.6 cm), the first and second cross perforations are separated by an odd number of half-inch intervals (17), but the first and third perforations are separated by an even number of such intervals (34). Therefore, with crimp blade spacing in an even number of half-inch intervals, it is not possible to prevent at least some crimps from coinciding with cross-perforations. Thus, it can be seen that a particular arrangement of crimp blades that is suitable for use with 11-inch forms is not usable with $8\frac{1}{2}$ inch forms, and vice versa.

Typically, the problem of crimp spacing for different sizes of forms is solved by providing two different crimp blade holders, one size for each of the different forms. When the collator is to be readied for changing from one size form to another, the blade holders mounted to the rotatable shaft must be disassembled and removed from the shaft, and a new set of blade holders providing a different spacing must be installed. This represents a relatively time-consuming process, and requires the operator of the collator to keep two sets of crimp blade holders on hand. Moreover, two sets of parts is costly. In addition, it is necessary to change the gearing for driving the crimp blade holder shaft in synchronism with the web, which is also time-consuming and inconvenient.

A second method is to rotate the crimp blade holder at different speeds, depending upon the size of the form. This method also requires a gearing change, and requires that with at least some sizes of forms, the blade holder must be rotated at a different speed than that of the web. The different speeds may result in tearing of the web by the crimp blades.

What is needed, therefore, is a single set of crimp blade holders that are capable of use with either $8\frac{1}{2}$ or 11 inch forms. Such holders should be capable of arranging crimp blades such that in either case, crimps do not coincide with perforations along the multilayer web. Further, use of the crimp blade holders with one size of form following use with another size form should not require any modifications or adjustments to the blade holders, or changing of driving gears to synchronize crimping to form length.

SUMMARY OF THE INVENTION

The present invention provides a crimp blade holder for attachment to a rotatable shaft for removably mounting a plurality of crimp blades. The holder, which is then used in crimping the edges of a moving web, mounts the blades such that the blade holder may be used during the production of either $8\frac{1}{2}$ or 11 inch forms.

The blade holder includes a cylindrical body having a curved outer surface, with an axial bore defined through the cylindrical body for mounting the body to a shaft. Means securing the body to the shaft is provided, so that the body may be axially rotated thereby. Means for mounting the crimp blades to the body in predetermined fixed locations with respect to its outer surface is also provided so that rotation of the body causes the blades to crimp a web moving therepast. The diameter of the body and the positions of the blade mounting means on the outer surface are selected so that with 8 blades mounted to the body, rotation thereof causes crimps to be applied to the moving web with spacings thereon between successive crimps defining a repetitive pattern of substantially 2.0, 2.0, 2.0, 2.0, 2.0, 2.0, 2.0 and 3.0 inches (5.08, 5.08, 5.08, 5.08, 5.08, 5.08, 5.08 and 7.62 cm).

The present invention further provides a method for crimping of a moving web, which includes the formation of the perforation at least partially across the web, substantially perpendicular to and crossing a line parallel to the direction of movement of the web. A first crimp is applied to the web along the line behind the perforation with respect to the direction of travel of the web, with a predetermined spacing from the perforation. Second, third, fourth, fifth, sixth, seventh, and eighth crimps are then applied to the web along the line, each crimp being applied at a spacing from the immediately preceding one of substantially 2.0 inches (5.08 cm). The next crimp is applied to the web along the line at a spacing from the preceding crimp of substantially 3.0 inches (7.62 cm). This crimp serves as the first crimp of the next repetition of the crimping pattern, followed by the second through eighth crimps as described above.

Successive perforations are also applied to the web, each being formed with a spacing from the first perforation of either $8\frac{1}{2}$ or 11 inches, depending upon the length of the form being produced.

Accordingly, it is an object of the present invention to provide a crimp blade holder for removably mounting a plurality of crimp blades for crimping a moving web in accordance with a predetermined pattern; to provide such a holder that will produce crimps along a moving web consisting of either $8\frac{1}{2}$ or 11 inch forms without coinciding with perforations along located along the web; to provide such a holder that is usable with any of several common sizes of forms; and to provide such a holder that is usable with several sizes of forms without requiring changing or modification of the holder when changing from production of one size forms to another.

Other objects and advantages will be apparant from the following description, the accompanying drawings, and the appended claims.

DETAILED DESCRIPTION OF THE PREFERRED EMBODIMENT

Figure 2:
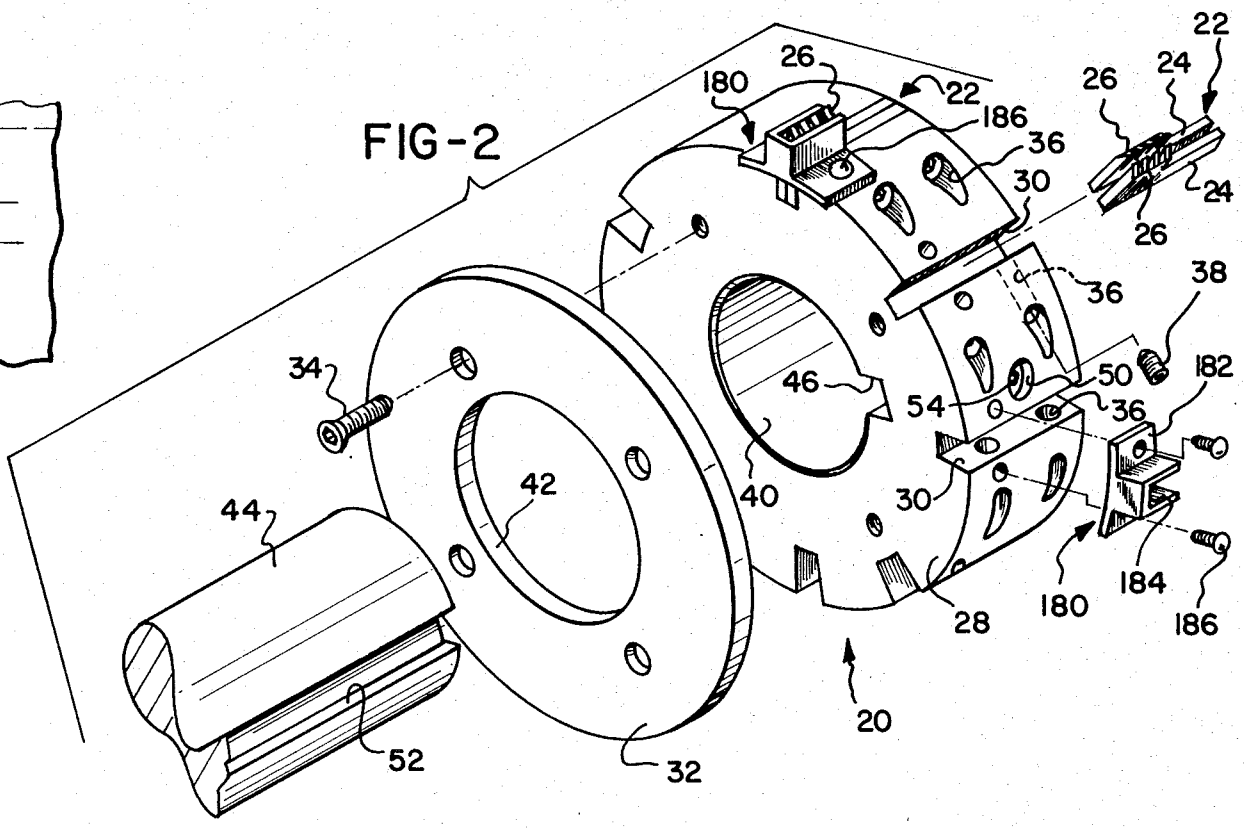
FIG. 2 is an exploded perspective view of a crimp blade holder of the present invention for crimping one edge of a web.
Figure 1:
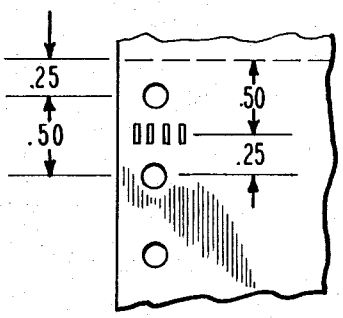
FIG. 1 is a plan view of a portion of a multipart paper web, showing relative spacings therealong of registration holes, a perforation, and a crimp, in which the dimensions presented are in inches.

Referring generally to the drawings, and in particular to FIG. 2, a crimp blade holder 20 is shown for removably mounting a plurality of crimp blades 22. The present invention is equally usable with a variety of types of conventional crimp blades, although for illustrative purposes, one type of crimp blade 22 is shown including two halves 24. Each blade 22 is also provided with a plurality of teeth 26 for crimping a web, the outermost tips of teeth 26 defining the leading edge of blade 22.

Blade holder 20 includes a cylindrical body 28 having a plurality of slots 30 located along the periphery of body 28. A plate 32 is attached by bolts 34 to the end of body 28, thereby closing off one end of each slot 30. A crimp blade 22 may be inserted into each of the slots 30. Plate 32 provides for accurate positioning of a blade 22 within each slot 30, with the blade 22 being inserted into slot 30 so as to abut plate 32.

A pair of threaded bores 36 are provided for each slot 30 through body 28, opening into the slot 30 through one of its side walls. Each bore 36 is oriented to intersect the side wall perpendicular thereto, and opens at its opposite end along the periphery of body 28. Each bore 36 is adapted to receive a set screw 38, which may be advanced or retracted along bore 36 by an appropriate tool, such as an Allen wrench (not shown). When a crimp blade 22 is inserted into a slot 30, the set screws 38 disposed within the corresponding bores 36 are advanced and tightened against the blade 22, thereby clamping blade 22 firmly in place.

Body 28 and plate 32 each include a central opening 40 and 42, respectively, for placement of the respective portion upon a shaft 44. Groove 46 is provided extending the full length of opening 40, and a threaded bore 50 extends through body 28, opening into opening 40 through groove 46. A similar groove 52 is provided along shaft 44, extending the full length of the outer surface thereof. Grooves 46 and 52 cooperate when body 28 and attached plate 32 are mounted to shaft 44 to form a keyway for proper positioning of body 28 on shaft 44. A key (not shown) is inserted into groove 52 of shaft 44, and also fits into groove 46 on body 28. A set screw 54 engageable with threaded bore 50 is inserted into body 50 and advanced toward and tightened against the key, thereby securing body 28 in a desired position along shaft 44.

Figure 3:
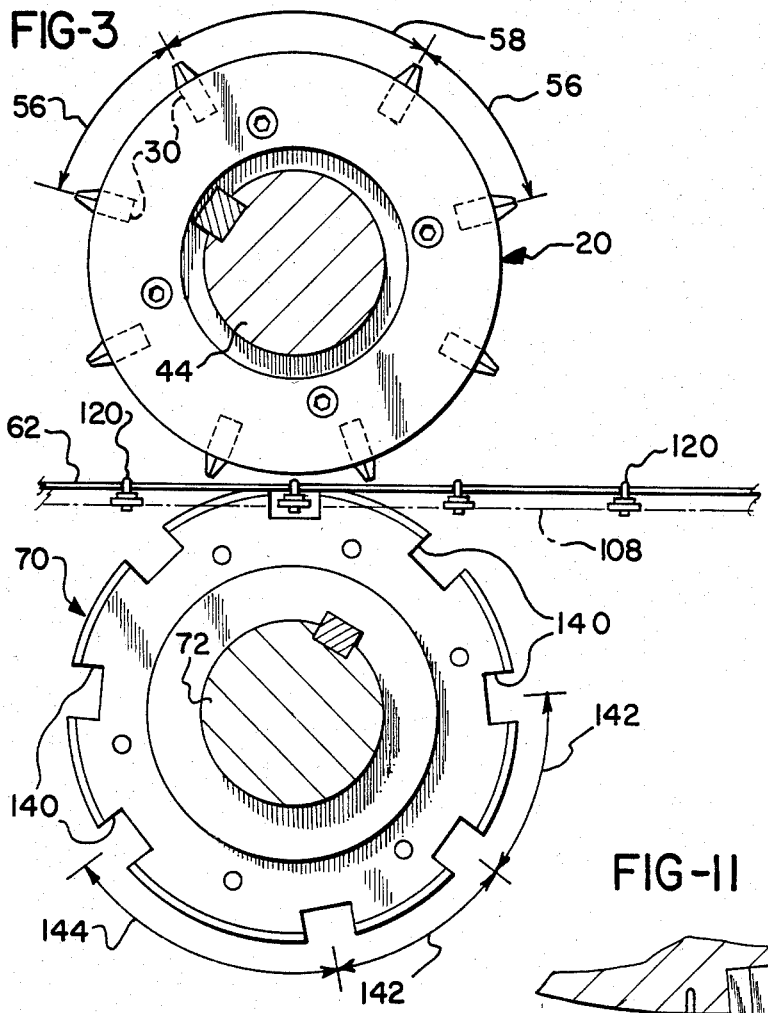
FIG. 3 is an end view of the crimp blade holder and a corresponding anvil surface member.

The relative spacing between adjacent slots 30 disposed along the periphery of blade holder 20 for mounting blades 22 can be seen in FIG. 3. The eight slots 30 are arranged such that the distance between all but one of any adjacent pair of blades 22 along a circle defined by the centers of the pitch line of blades 22 and mounted within slots 30, as indicated generally by arrows 56, is 2 inches (5.08 cm). One adjacent pair of blades 22, however, are arranged such that the distance between the adjacent pair along the described circle is 3 inches (7.62 cm), indicated generally by arrow 58. Thus, blades 22 inserted into slots 30 will produce a series of eight crimps along a web having a center to center spacing of 2.0, 2.0, 2.0, 2.0, 2.0, 2.0, 2.0, and 3.0 inches (5.08, 5.08, 5.08, 5.08, 5.08, 5.08, 5.08 and 7.62 cm) between adjacent crimps.

Figure 4:
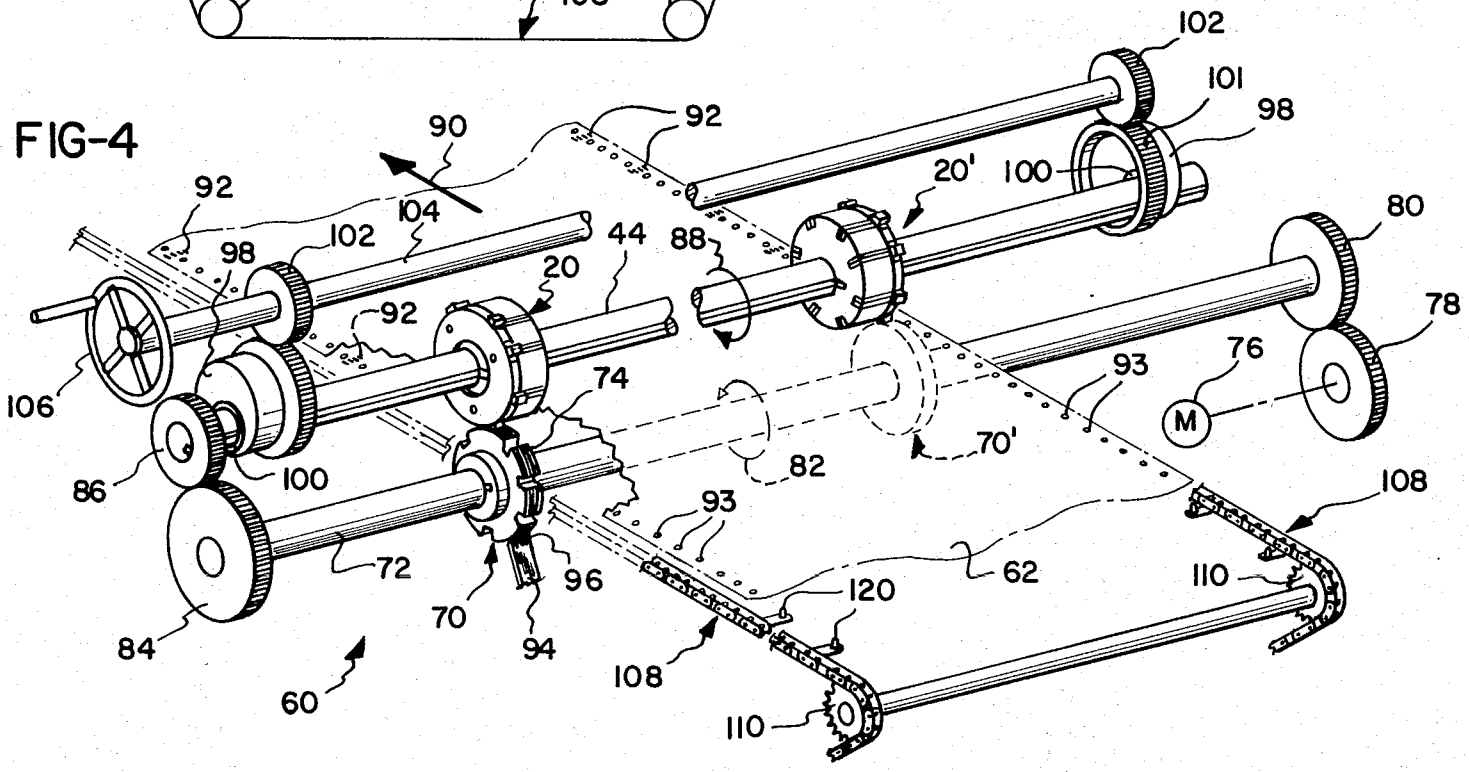
FIG. 4 is a perspective, partially schematic view of an apparatus for crimping the edges of a paper web, including the crimp blade holders of the present invention.

The apparatus 60 with which blade holder 20 is used for crimping a moving web is shown in schematic fashion in FIG. 4. A pair of blade holders 20 and 20′ are mounted to shaft 44 for providing crimps along both edges of a moving web 62. It will be recognized by comparing blade holder 20 and blade holder 20′ that the holders include both a left hand holder 20 and a right hand holder 20′. While these holders are generally of identical construction, positioning of grooves 46 on the bodies 28 of each blade holder are such that the blade holders 20 and 20′ are mounted to shaft 44 with relative circumferential positioning such that identical crimping patterns are produced on each edge of web 62 without any phase difference therebetween.

Blade holders 20 and 20′ are further distinguished by the direction from which threaded bores 36 (see FIG. 2) approach the blade mounting slots 30. By providing these variations in blade holders 20 and 20′, it can be seen that an operator can manipulate set screws 38 in either blade holder for insertion or removal of blades 22 from the same side of shaft 44.

A pair of anvil surface members 70 and 70′, to be described in detail below, are mounted to a rotatable shaft 72. Each anvil member 70 and 70′ is provided with a plurality of annular grooves 74 adapted such that teeth 26 of blades 22 will fit into grooves 74.

Anvil surface members 70 and 70′ are mounted to shaft 72 using keys, keyways and set screws in a manner similar to that described above for blade holders 20 and 20′. Thus, the lateral positions of blade holders 20 and 20′ and anvil surface members 70 and 70′ may be adjusted along their respective shafts. Thus, the crimping apparatus described herein may be used with forms of various widths, or may be used to place the crimps in location other than at the edges of the web.

Shaft 72 is driven at one end by motor 76 through gears 78 and 80, in a direction indicated by arrow 82. A gear 84 is mounted to the opposite end of shaft 72, and engages a gear 86 mounted to one end of shaft 44. Thus, motor 76 and gears 78 and 80 also drive shaft 44, rotating it in a direction indicated by arrow 88.

Web 62 is passed between shafts 44 and 72 in the direction indicated by arrow 90. During the crimping operation, shafts 44 and 72 are spaced such that teeth 26 of blades 22 mounted to blade holders 20 and 20′ engage the annular grooves 74 of anvil surface members 70 and 70′. Web 62 is passed along anvil surface members 70 and 70′, and teeth 26 of blades 22 perforate web 62, providing a plurality of crimps 92 along the edges of web 62. Crimps 92 are spaced to avoid registration holes 93, already formed along both edges of web 62.

Gears 78 and 80 and gears 84 and 86 are appropriately selected so that the surfaces of anvil surface members 70 and 70′ and the teeth 26 of blades 22 are rotated with a linear speed equal to the speed of the moving web 62.

Each anvil surface member 70 and 70′ is provided with a cleaner 94 disposed adjacent member 70 on a side opposite web 62. Each cleaner 94 has a plurality of fingers 96 extending one each into each of the annular grooves 74 of member 70 and 70′. Fingers 96 act during rotation of members 70 and 70′ to clear any paper dust or other debris from grooves 74.

In order to initially thread web 62 through apparatus 60, or to replace or service any of the blade holders, crimp blades, and the like, it is necessary to move blade holders 20 and 20′ so that blades 22 are out of engagement with web 62. In order to disengage the blades, advance of web 62 is halted. Shaft 44 is then raised away from web 62, thereby raising blades 22 from anvil surface members 70 and 70′. Gears 84 and 86 are not completely disengaged, however, so that the synchronism of blades 22 and anvil surface members 70 and 70′ is not lost, for reasons that will be explained below.

In order to raise and lower shaft 44, a pair of eccentric bearing housings 98 are provided near each end of shaft 44. Bearings 100 are mounted into each housing 98 so that shaft 44 is freely rotatable within the housings 98, which in turn are journalled to a support frame (not shown). A gear 101 is mounted concentrically to an end of each housing 98. A pair of gears 102, mounted to a shaft 104, engage gears 101. Shaft 104 may be rotated by a handle 106 or the like, so that rotation of handle 106 rotates gears 101 and thus housings 98, raising and lowering shaft 44. Blades 22 are thereby moved into and out of operating position.

Figure 5:
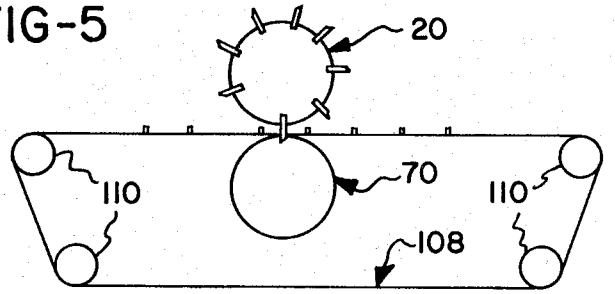
FIG. 5 is a schematic diagram of the path of the chain for advancing the web through the apparatus of FIG. 4.

The web 62 is advanced through apparatus 60 by a pair of driven chains 108. Each chain 108 is engaged with a plurality of cooperating sprockets 110, as shown schematically in FIG. 5, at least one of which is driven so as to move chain 108 at a speed identical to that of the advance of web 62.

Figure 6:
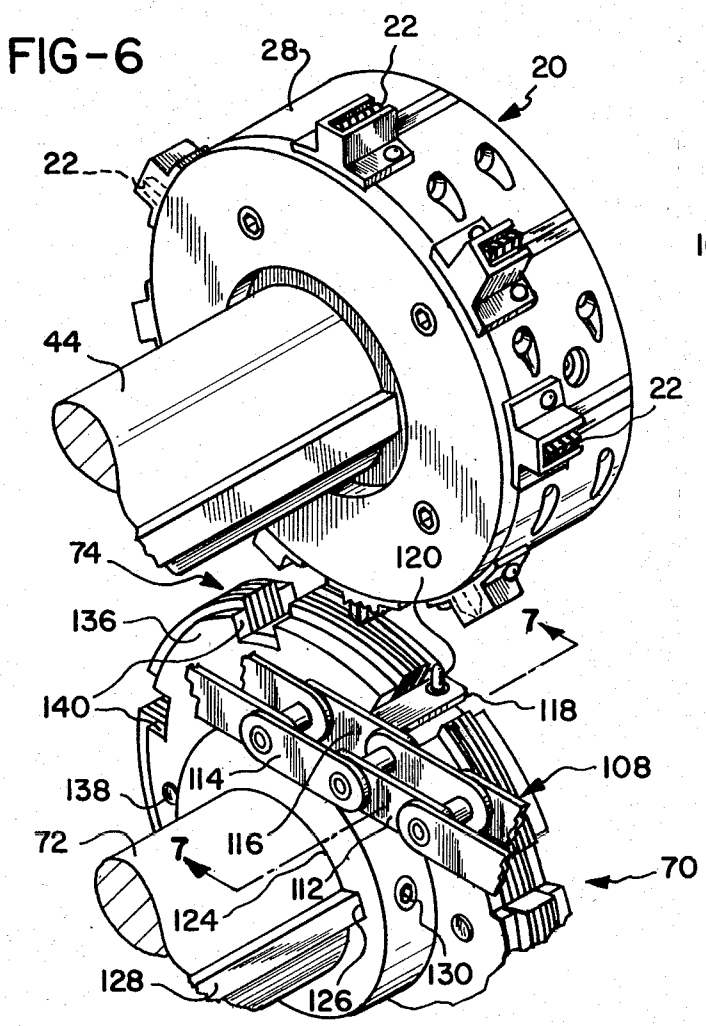
FIG. 6 is a perspective view of the assembled crimp blade holder of FIG. 2, also showing portions of a cooperating anvil surface member and the chain for advancing the web.

Referring to FIG. 6, chain 108 may be seen in some detail. Links 112 and connecting links 114 are attached by riveting in conventional fashion. A plurality of connecting links 116 having a support arm, or outrigger, 118 integrally attached thereto are periodically substituted for connecting links 114 along one side of each of chains 108. A pin 120 is mounted near the outer end of each support arm 118, and is of a size so as to fit within the registration holes provided along the edges of web 62. Engagement of the registration holes with pins 120, in conjunction with driving movement of chains 108, advances web 62 as seen by reference back to FIG. 4.

Figure 7:
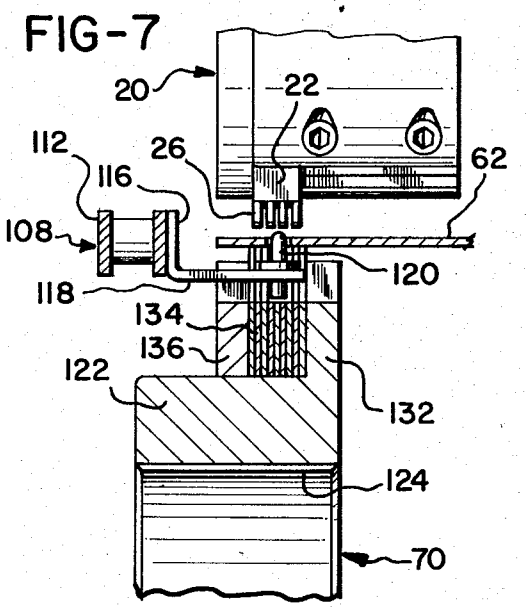
FIG. 7 is a sectional view taken generally along line 7—7 of FIG. 6.

The construction of the anvil surface member 70 is shown in detail in FIGS. 6 and 7. A hub 122 is provided with a central opening 124 for placement of hub 122 on shaft 72. A groove 126 extends the length of opening 124, and cooperates with a similar groove placed along the length of shaft 72 for insertion thereinto of a key 128 for holding hub 122 in circumferential position on shaft 72. A threaded bore extends radially through hub 122 and communicates with groove 126 for insertion thereinto of a set screw 130. Advancement of set screw 130 into the threaded opening by an Allen wrench (not shown), or the like, against key 128 secures hub 122 in place along shaft 72.

An annular flange 132 extends around hub 122 at one end thereof. A plurality of annular plates 134 of alternating heights are positioned on hub 122 against flange 132, for defining the plurality of grooves 74 into which the teeth 26 of crimp blade 22 are inserted for crimping web 62. An annular spacer 136 is placed on hub 122 adjacent plates 134, and is secured in place to flange 132 by a plurality of bolts 138 or the like.

Because the crimps formed along the edges of web 62 are typically placed along the same longitudinal line as the registration holes, it is often necessary for pins 120 and supporting arms 118 to be passed through the area in which the crimp blades 22 are cooperating with the anvil surface member 70 to crimp the web. To enable pins 120 and support arms 118 to pass through this area, a plurality of slots 140 are formed in the anvil surface member 70, extending across flange 132, plates 134, and spacer 136. As each pin 120 and supporting arm 118 is moved to anvil surface member 70 by chain 108, pin 120 and arm 118 will enter a slot 140 as seen in FIG. 7. This contact with member 70 is avoided.

The relative placement of the slots 140 about the periphery of anvil surface member 70 may seen by reference back to FIG. 3. During rotation of blade holder 20 and anvil surface member 70, crimp blades 22 carried by holder 20 cannot be permitted to align with one of the slots 140 since not only will a crimp be incompletely or improperly formed, but the blade 22 will also strike one of pins 120 which is being moved through the slot 140. Thus, eight slots 140 are provided around the periphery of anvil supporting member 70, with the center-to-center spacing between all but one adjacent pair of slots 140 being 2.0 inches (5.08 cm) as indicated generally by arrows 142. One pair of adjacent slots, however, are arranged so that the distance between the slots 140 is 3.0 inches (7.62 cm), indicated by arrow 144. The anvil surface member 70 is then circumferentially positioned with respect to blade holder 20 so that each crimp blade 22 carried by holder 20 will engage the grooves of anvil supporting member 70 between one pair of slots 140.

It will also be readily seen that it is necessary for pins 120 to be provided with a spacing compatible with the slots 140 defined on anvil surface member 70. Therefore, connecting links 116, along with the attached support arm 118 and pin 120, are provided along each chain 108 in repetitive sets of eight having a center-to-center spacing of 2.0, 2.0, 2.0, 2.0, 2.0, 2.0, 2.0, and 3.0 inches (5.08, 5.08, 5.08, 5.08, 5.08, 5.08, 5.08 and 7.62 cm).

Figure 8:
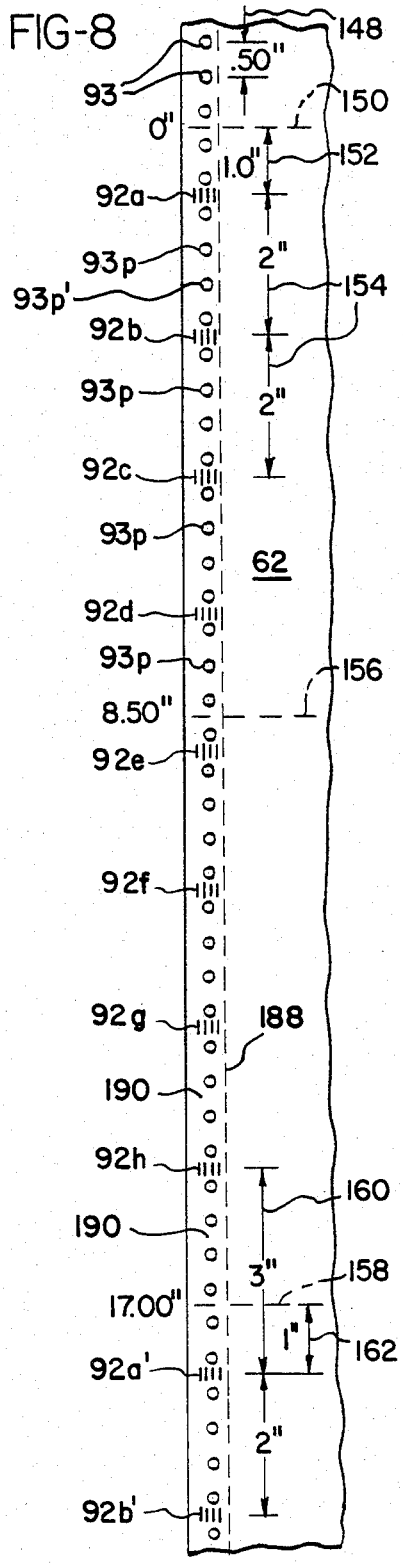
FIG. 8 is a plan view of a portion of a multilayer web showing the locations of crimps produced by the crimp blade holder along a series of $8\frac{1}{2}$ inch (21.6 cm) forms, in which the dimensions are shown in inches.
Figure 9:
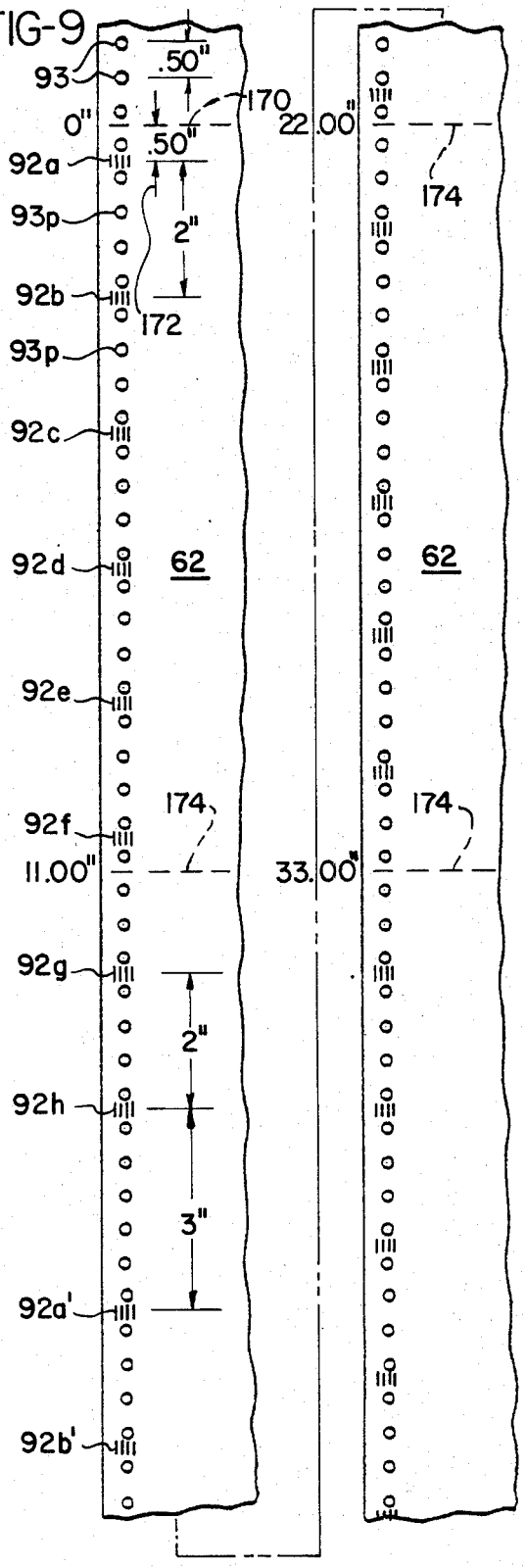
FIG. 9 is a plan view of a portion of a web showing the locations of crimps produced by the holder along a series of 11 inch (27.9 cm) forms.

The crimp pattern produced by blade holder 20 is shown in FIGS. 8 and 9. It will be understood that all spacing dimensions described in connection therewith represent the center-to-center spacings of the items in question. In FIG. 8, a portion of the edge of a web 62 is shown for illustrating the application of the crimps in the case of 8½ inch (21.6 cm) forms. Holes 93 are provided along the edge of web 62, with a spacing of 0.50 inch (1.27 cm) between adjacent holes 93, illustrated by arrows 148. A perforation 150 extends across web 62, centered 0.25 inch (0.635 cm) between adjacent holes 93, defining the division between successive forms. The location of perforation 150 is at a position along web 62 designated, for purposes of discussion, as 0" (0 cm).

The first crimp **92*a* of the crimp pattern is applied to web 62 1.0 inch (2.54 cm) below perforation 150, as indicated by arrow 152. The next succeeding crimps 92*b* and 92*c* are applied to the web with a spacing of 2.0 inches (5.08 cm) from the preceding crimp, indicated by arrows 154. Crimps 92*d* through 92*h*** follow in similar fashion.

A perforation 156 defines the beginning of the next succeeding form at a position indicated as 8.50" (21.6 cm), located with a spacing of 0.50 inch (1.27 cm) from crimp **92*e*. Similarly, perforation 158**, located at the 17.00" (43.2 cm) position, defines the beginning of the next following form.

Following the application of crimp **92*h* to web 96, the next succeeding crimp 92*a*' will be produced on web 62 with a spacing of 3.0 inches (7.62 cm) from crimp 92*h*, as indicated by arrows 62. It will be noticed, however, that since eight crimps have already been placed on web 106, corresponding to one for each of the eight crimp blades 22 carried by blade holder 20, the crimp pattern has been begun again. Thus, the crimp pattern demonstrated by crimps 92*a* through 92*a*'** will be repeated in similar fashion.

Additional perforations are continuously located on web 62 at 8.50 inch (21.6 cm) intervals. As can be seen from FIG. 8, none of the crimps 92 applied to web 62 will coincide with any of perforations 150, 156, or 158. Moreover, beyond perforation 158, located at the 17.00" (43.2 cm) position along web 62, the next succeeding crimp **92*a*' is located at a spacing from perforation 158 of 1.0 inch (2.54 cm), indicated by arrow 162. It will be seen that this is identical to the spacing between perforation 150 and crimp 92*a*, and thus the entire pattern illustrated by FIG. 8 will be continuously repeated. It can therefore be seen that in no instance will any of crimps 92** coincide with any perforation.

As the crimps 92 are being applied to web 62, web 62 is being carried through the apparatus by chains 108 (shown in FIG. 4) through pins 120 which engage various ones of registration holes 93. As can be seen by reference to FIG. 3, the particular holes 93 with which pins 120 are engaged cannot be immediately adjacent to a crimp 92, since the pin 120 and its associated support arm 118 must pass through one of the slots 140 carried on anvil support member 70. Accordingly, as shown in FIG. 8, a pin 120 will be engaged with the hole 93 designated as hole **93*p* between crimps 92*a* and 92*b*. (It will be recognized that pin 120 could alternatively engage hole 93*p*'**.)

Since the registration pins 120 are carried by chain 108 with a relative spacing identical to that with which the crimps are applied, each hole **93*p* with which a pin 120 is engaged will be spaced from the immediately preceding crimp by an equal amount. Thus, a series of holes 93*p* are shown, each following a crimp 92** by an interval of 0.75" (1.90 cm).

The crimp pattern produced during the manufacture of 11 inch (27.9 cm) forms is shown in FIG. 9. Here, two consecutive sections of the edge of a web 62 are shown, in which holes 93 have been again formed with a spacing between adjacent holes 93 of 0.50 inch (1.27 cm). A perforation 170, located along web 62 at a position arbitrarily designated 0", defines the division between a pair of successive forms. In this case, however, the first crimp 92*a* of the crimp pattern is positioned with a spacing of only 0.50 inch (1.27 cm) from perforation 170, as indicated by arrows 172. As has been previously described, successive crimps 92*b* through 92*h* of the crimp pattern are formed at 2.0 inch (5.08 cm) intervals, with the repetition of the pattern beginning with crimp 92*a'*, which is spaced from crimp 92*h* by 3.0 inches (7.62 cm).

Successive perforations 174 are provided along web 62 at intervals of 11.0 inches (27.9 cm). While in this case, the entire pattern of crimps and perforations will not begin to repeat until the 187.00" (475.0 cm) position (not shown), it should be recognized that all successive crimps are separated by an integral number of inches. Since successive perforations are separated by an integral number of inches, and since the initial crimp 92*a* is separated from perforation 170 by 0.50 inch (1.27 cm), none of crimps 92 will coincide with any of perforations 174. Further, blade holder 20 is thus suitable for use with any form having a length of an integral number of inches, such as 8 inch (20.3 cm) or 12 inch (30.5 cm) forms.

In using a toothed crimp blade such as blade 22 for the crimping of a multipart web, withdrawal of the blade teeth from the web during the crimping operation tends to cause "plucking" of the web. In such a case, withdrawal of the blade teeth from the web causes all or some of the web parts, or layers, to be lifted upward from their normal path of travel in the region of the newly-formed crimp. This can damage the strength of the crimp, possibly resulting in unwanted separation or improper registration of the various parts of the finished form.

Referring back to FIG. 2, plucking is prevented by providing blade holder 20 with a plurality of web stripping members 180 mounted to body 28 around the teeth 26 of each blade 22 when mounted to holder 20. Members 180 are constructed of a resilient material, preferably molded from a polyurethane material, and include a base portion 182 and an outwardly extending flange portion 184. Flange 184 is adapted to surround teeth 26 of blade 22 on three sides and extends to a normal height even with the outermost tips of teeth 26 when in position on holder 20.

Member 180 is mounted to portion 32 by a pair of buttons 186 which pass through a pair of holes defined in the base 182 of member 180. Buttons 186 are in turn secured within body 28, and may be formed, for example, by screws driven into the outer surface of body 28. Because member 180 is constructed of a resilient material, it may be mounted to body 28 by snapping the openings in base 182 over the heads of buttons 186, and may be removed from body 28 in reverse fashion. Thus, installation and/or replacement are facilitated.

Since the web stripping members are molded as a single piece, they can be manufactured quite inexpensively, thereby making their use practical. Moreover, since installation of buttons 186 onto a blade holder is easily accomplished by driving screws into the holder surface, use of the members 180 with presently-existing blade holders on a retrofit basis can be easily carried out.

Figure 11:
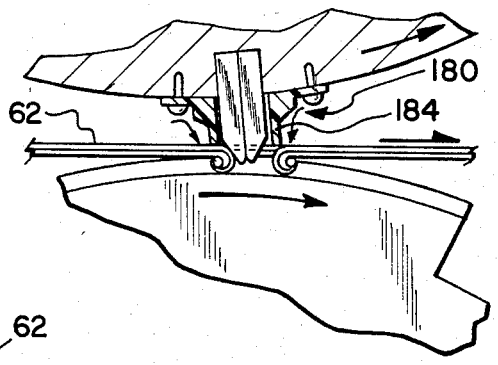
FIG. 11 is a view similar to FIG. 10, further illustrating operation of the web stripping member.
Figure 10:
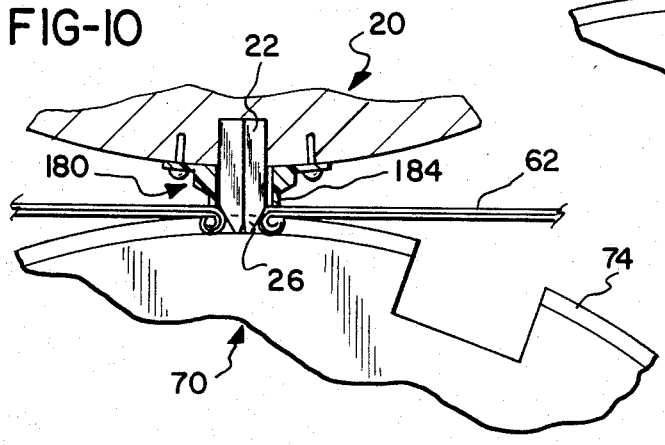
FIG. 10 is a sectional view of a portion of the crimp blade holder, illustrating the operation of a web stripping member.

The operation of web stripping member 180 may be seen by reference to FIGS. 10 and 11. In FIG. 10, the teeth 26 of blade 22 have been inserted through web 62 for crimping thereof. When teeth 26 enter the grooves 74 within anvil surface member 70, flange 184 of member 180 is compressed between anvil surface member 70 and blade holder 20. In FIG. 11, as rotation of blade holder 20 moves blade 22 and member 180 beyond anvil surface member 70, the resiliency of member 180 causes flange 184 to return to its original height substantially equal to the height of the tips of teeth 26. This resilient force is exerted downwardly upon the web 62, pushing it from engagement with teeth 26, thereby preventing plucking of the web by the blade 22.

One consideration associated with the use of web stripping members 180 arises from the frequent use of multipart forms for generating multiple copies of a single form. In such cases, carbon paper is either interspersed between the various parts of the multipart web, or "carbonless" paper is used for the individual parts, in which pressure on the outermost part is transferred as markings to the underlying parts.

Because the web-stripping members 180 apply a force to the web to urge it from the teeth of the crimp blades 22, each member 180 leaves an impression, or "footprint", of the U-shaped member on the underlying parts of the web around the crimps. This footprint can be objectionable if it is too dark or intrudes into the usable portion of the form.

One approach to minimizing the effect of the footprint is to carefully confine it to a portion of the form which is typically discarded. Referring back to FIG. 8, a longitudinal perforation 188 is typically applied near each edge of the form, typically spaced from $\frac{1}{2}$ to $\frac{5}{8}$ inches (1.27 to 1.59 cm) from the form edge. Perforation 188 then defines a region 190 of the form usually referred to as the "stub". The stub 190 contains the registration holes 93 and the crimps 92 and, after the form has been used, stub 190 is generally separated from the remainder of the form and discarded. Thus, if the web-stripping members 180 are carefully sized so that the footprint occurs only within stub 190, removal and discarding of the stub 190 will eliminate the footprints as well.

A second approach, which can be used in conjunction with the approach set forth above, is to select a hardness for the polyurethane material comprising the members 180 that is sufficiently hard to be effective in stripping the web from blades 22, but yet is sufficiently soft to minimize or eliminate the footprints. It has been found that a hardness of approximately 55–60 on the Shore A scale produces little marking of the form, yet is effective in stripping the web 62 from the blades 22.

While the method and form of apparatus herein described constitute preferred embodiments of this invention, it is to be understood that the invention is not limited to this precise method and form of apparatus, and that changes may be made in either without departing from the invention, which is defined in the appended claims.

What is claimed is:

1. A holder mounting a plurality of crimp blades for crimping of a moving web, comprising:

a cylindrical body having a curved outer surface;

an axial bore defined through said cylindrical body for mounting said body to a shaft;

means securing said body to the shaft such that said body may be axially rotated thereby; and means for mounting the crimp blades to said body in predetermined fixed locations with respect to said outer surface such that rotation of said body causes the blades to crimp a web moving therepast;

the diameter of said body and the positions of said blade mounting means on said surface thereof being selected so that with a plurality of blades mounted to said body, rotation thereof causes crimps to be applied to the moving web with spacings thereon between successive crimps defining a repetitive pattern of substantially 2.0, 2.0, 2.0, 2.0, 2.0, 2.0, 2.0 and 3.0 inches (5.08, 5.08, 5.08, 5.08, 5.08, 5.08, 5.08 and 7.62 cm).

2. A holder as defined in claim 1, wherein said blade holding means includes eight slots defined in said outer surface of said body, and means for securing one of the crimp blades within each of said slots.

3. A method of applying crimps to a moving web along a line parallel to the direction of movement of the web, comprising the steps of:

(a) applying a first crimp to the web;

(b) applying a next crimp to the web at a spacing from the preceding one of said crimps of substantially 2.0 (5.08 cm) inches;

(c) applying a next crimp to the web at a spacing from the preceding one of said crimps of substantially 2.0 inches (5.08 cm);

(d) applying a next crimp to the web at a spacing from the preceding one of said crimps of substantially 2.0 inches (5.08 cm);

(e) applying a next crimp to the web at a spacing from the preceding one of said crimps of substantially 2.0 inches (5.08 cm);

(f) applying a next crimp to the web at a spacing from the preceding one of said crimps of substantially 2.0 inches (5.08 cm);

(g) applying a next crimp to the web at a spacing from the preceding one of said crimps of substantially 2.0 inches (5.08 cm);

(h) applying a next crimp to the web at a spacing from the preceding one of said crimps of substantially 2.0 inches (5.08 cm);

(i) applying a next crimp to the web at a spacing from the preceding one of said crimps of substantially 3.0 inches (7.62 cm); and (j) repeating at least once steps (b) through (i).

4. A method as defined in claim 3, wherein:

said web into which said crimps are formed includes a first perforation at least partially across the web, substantially perpendicular to and crossing said line, and a plurality of additional perforations, each of said perforations being located along said web with a spacing from the preceding one of said perforations of substantially 8.50 inches (21.6 cm); and said first crimp is formed behind said first perforation with respect to the direction of travel of the web with a spacing from said perforation of substantially 1.0 inch (2.54 cm).

5. A method as defined in claim 4, wherein:

said web into which said crimps are formed includes a plurality of holes through the web along said line, each of said holes being located along said web with a spacing from the preceding one of said holes of substantially 0.50 inch (1.27 cm); and said first crimp is formed with a spacing from one of said holes of substantially 0.25 inch (0.635 cm).

6. A method as defined in claim 3, wherein:

said web into which said crimps are formed includes a first perforation at least partially across the web, substantially perpendicular to and crossing said line, and a plurality of additional perforations, each of said perforations being located along said web with a spacing from the preceding one of said perforations of substantially an integer multiple of 1.0 inch (2.54 cm); and said first crimp is formed behind said first perforation with respect to the direction of travel of the web with a spacing from said perforation of substantially 0.50 inch (1.27 cm).

7. A method as defined in claim 6, wherein:

said web into which said crimps are formed includes a plurality of holes through the web along said line, each of said holes being located along said web with a spacing from the preceding one of said holes of substantially 0.50 inch (1.27 cm); and said first crimp is formed with a spacing from one of said holes of substantially 0.25 inch (0.635 cm).

* * * * *